United States Patent [19]

Fiala

[11] 4,307,692

[45] Dec. 29, 1981

[54] FUEL INJECTION APPARATUS

[75] Inventor: Ernst Fiala, Wolfsburg, Fed. Rep. of Germany

[73] Assignee: Volkswagenwerk Aktiengesellschaft, Fed. Rep. of Germany

[21] Appl. No.: 62,950

[22] Filed: Aug. 2, 1979

Related U.S. Application Data

[63] Continuation of Ser. No. 829,457, Aug. 31, 1977, abandoned.

[30] Foreign Application Priority Data

Sep. 4, 1976 [DE] Fed. Rep. of Germany ..... 2539920

[51] Int. Cl.[3] ..... F02M 7/00

[52] U.S. Cl. ..... 123/445; 261/50 A; 261/69 R

[58] Field of Search ..... 123/139 AW, 119 R, 124 R, 123/DIG. 10, 445, 434; 261/36 A, 50 A, 69 R, DIG. 69

[56] References Cited

U.S. PATENT DOCUMENTS

| | | | |
|---|---|---|---|
| 2,839,154 | 6/1958 | Sterner | 123/119 R |
| 2,882,879 | 4/1959 | Dolza | 123/139 AW |
| 3,286,998 | 11/1966 | Mennesson | 123/139 AW |
| 3,346,245 | 10/1967 | Mennesson | 261/69 R |
| 3,350,074 | 10/1967 | Kalert, Jr. et al. | 261/69 R |
| 3,498,274 | 3/1970 | Chapman | 123/139 AW |
| 3,659,564 | 5/1972 | Suzuki et al. | 123/119 R |

*Primary Examiner*—Ira S. Lazarus
*Assistant Examiner*—Magdalen Moy
*Attorney, Agent, or Firm*—Brumbaugh, Graves, Donohue & Raymond

[57] ABSTRACT

A fuel injection apparatus provides a rich fuel-air mixture which is injected into the intake manifold of an internal combustion engine in the vicinity of the intake ports of the cylinders. The quantity of fuel provided to the engine is regulated in accordance with the negative pressure in the engine air intake passage.

3 Claims, 1 Drawing Figure

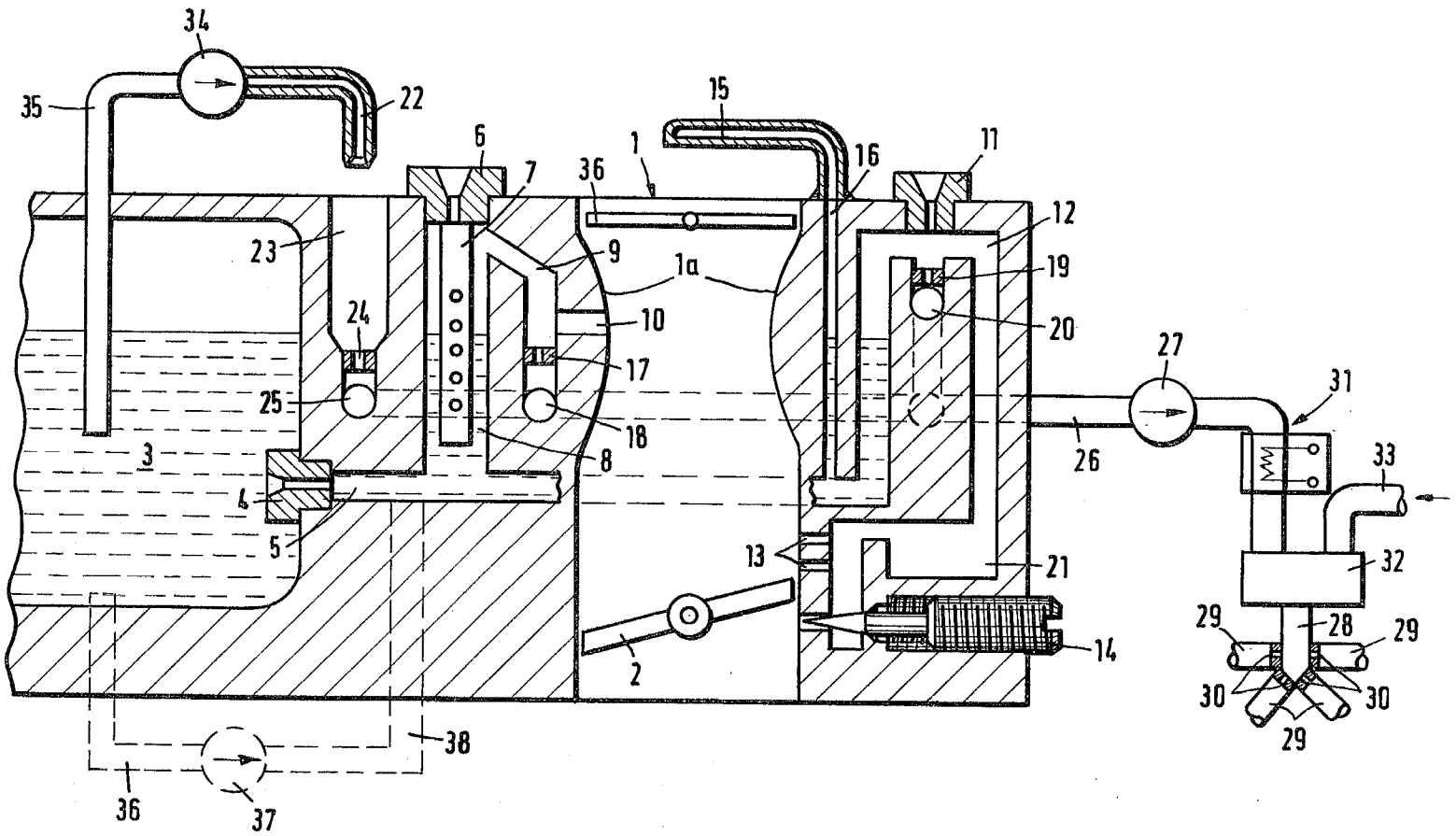
1
1a
2
3
4
5
6
7
8
9
10
11
12
13
14
15
16
17
18
19
20
21
22
23
24
25
26
27
28
29
30
31
32
33
34
35
36
37
38

FUEL INJECTION APPARATUS

This is a continuation of Ser. No. 829,457, filed Aug. 31, 1977, now abandoned.

BACKGROUND OF THE INVENTION

This invention relates to fuel injection devices for internal combustion engines, and particularly to devices for injecting fuel into the intake manifold of such engines.

The requirements of low engine emissions for motor vehicles, and the demands for increased engine efficiency have required the development of devices for the accurate regulation of the quantity of fuel provided to internal combustion engines and for improved preparation of the fuel-air mixture used in such engines. Attempts at meeting emission and efficiency requirements have resulted in complex carburetor arrangements, which are expensive to manufacture and may tend to be unreliable in operation. As an alternative to carburetor redesign, fuel injecting devices which provide the direct supply of fuel to the engine combustion chambers have been used. Direct fuel injection, by reason of the high injection pressure required and small volume of fluid flow tend to be complex and expensive to manufacture.

It is therefore an object of the present invention to provide a new and improved fuel injection apparatus, which provides accurate control of fuel quantity and distribution without the complex mechanical effort required to provide direct fuel injection into the engine combustion chambers.

It is another object of the present invention to provide a fuel injection apparatus wherein effective fuel-air mixture preparation can be achieved.

SUMMARY OF THE INVENTION

In accordance with the invention, there is provided an apparatus for injecting fuel into the intake manifold of an internal combustion engine having at least one combustion chamber and an air-intake passage. The apparatus includes a first pump having an outlet which is connected to the engine intake manifold adjacent the intake port of each combustion chamber. There is provided means, including at least one jet nozzle, for supplying fuel mixed with air to the intake of the first pump. The quantity of fuel provided to the pump intake is regulated in accordance with the negative pressure in the air intake passage.

In a preferred embodiment, the devices include a float chamber which is connected by a first jet nozzle to a main fuel line and an idling fuel line. The air intake passage includes a venturi and a suction opening in the venturi communicating with the main fuel line. A second jet nozzle is arranged between the main fuel line and the intake of the first pump. A throttle may be arranged in the intake passage and bores may be provided connecting the idling fuel line with the air intake passage in the region of the throttle. The idling fuel line is connected to the first pump intake by a third jet nozzle. Additional air intake nozzles may be provided for supplying additional air to the main fuel line and idling fuel line. The idling fuel line may be provided with a chamber for the accumulation of excess fuel, which may be present in the idling fuel line when the pump is turned off. A second pump may be provided, operable on the rapid opening of the throttle valve, to supply additional fuel to the inlet of the first pump by way of a fourth jet nozzle. Alternately, the second pump may supply excess fuel to the main fuel line. A fuel enrichment tube can be used to supply fuel directly into the air intake passage when the engine is operating at a full load. A choke may also be provided in the air intake passage. The outlet of the first pump may be supplied to the intake manifold by means of a volume distributing device. There may also be provided a heating element for heating the fuel-air mixture at the outlet of the first pump, and a device for adding exhaust gasses to the fuel-air mixture.

For a better understanding of the present invention, together with other and further embodiments, reference is made to the following description, taken in conjunction with the accompanying drawings, and its scope will be pointed out in the appended claims.

BRIEF DESCRIPTION OF THE DRAWING

The FIGURE is a cross-sectional and schematic illustration of a fuel injection apparatus in accordance with the present invention.

DESCRIPTION OF THE INVENTION

The drawing illustrates a cross-sectional view of the apparatus of the present invention in the region of the engine air intake passage 1. The passage 1 is provided with a venturi 1*a* which is arranged, in the direction of flow, prior to a conventional throttle valve 2. Throttle valve 2 may be actuated to increase or decrease the engine output in a conventional manner. The fuel injection device is provided with a float chamber 3, similar to the chambers used in conventional carburetors, wherein the level of fuel is maintained substantially constant. A first jet nozzle 4 connects float chamber 3 to a fuel line 5. Fuel line 5 communicates with a main fuel line having sections 8 and 9, which connect to venturi 1*a* over passage 10. Fuel line 5 also communicates with an idling fuel line 12 which is connected by bores 13 to intake passage 1 in the region of throttle 2.

In the main fuel line, a mixing tube 7 is provided. Tube 7 projects into a mixing chamber which forms section 8 of the fuel line. An air inlet nozzle 6, which may be in communication with air intake passage 1, provides air to mixing tube 7. The inlet air is mixed with fuel in chamber 8 to produce a very rich fuel-air mixture which is provided to section 9 of the main fuel line. Section 9 of the main fuel line is connected to intake passage 26 of pump 27 by way of second jet nozzle 17 and a passage 18. Nozzle 17 promotes mixing of the fuel and air from the main fuel line.

Idling fuel line 12 is also connected with intake passage 26 of pump 27 by third jet nozzle 19 and passage 20. Idling fuel line 12 is provided with an air inlet nozzle 11, which supplies additional air to the fuel mixture in a manner similar to nozzle 6. Idling fuel line 12 is connected to intake passage 1 by bores 13 and has an additional connection to passage 1 on the downstream side of throttle 2. The additional passage is provided with idling air adjustment screw 14. Adjustment of screw 14 regulates the pressure in idling fuel line 12, and thereby adjusts the quantity of fuel provided to pump 27 from the idling fuel line. A chamber 21 is provided in idling fuel line 12 for the collection of excess fuel, which may enter the idling fuel line when the engine is turned off and pump 27 stops drawing fuel through passage 20.

In the embodiment illustrated, fuel line 5 is also connected to passage 16, which communicates with a fuel enrichment tube 15 located in inlet passage 1, prior to venturi 1*a*. Fuel enrichment tube 15 provides additional fuel directly into intake passage 1 when the engine is operating at full load.

An additional fuel passage 35 connects float chamber 3 with a second pump 34 which is operable upon rapid opening of throttle 2. Pump 34 supplies an additional quantity of fuel through passage 22 to collecting chamber 23. This excess fuel is mixed with air in a fourth jet nozzle 24 and supplied through passage 25 to the inlet passage 26 of pump 27. In the embodiment illustrated, fuel passages 18, 20, and 25 all connect with a common passage 26 which is connected to the inlet of pump 27. Pump 27, which could be an electrically driven gear pump, delivers the rich fuel-air mixture to a volume distributing device 28, to be evenly distributed by way of feeder nozzles 30 and delivery lines 29 to the intake manifold in the vicinity of the inlet ports of each of the cylinders of the engine. Preferably spraying nozzles are provided at the point of fuel injection into the intake manifold, to promote thorough mixture of the fuel supplied by pump 27 and the air supplied over air intake passage 1.

The characteristics of pump 27 and mixing nozzles 17 and 19 are chosen so that the pressure in fuel lines 9 and 12 are determined primarily by the pressure conditions prevailing in the intake passage 1, particularly in the region of connecting passages 10 and 13. In addition, pressures and flow areas must be selected so that fuel does not pass through these openings into intake passage 1, but the entire quantity of fuel is supplied through pump 27 to be provided at the intake manifold in the region of the intake ports of the cylinders. Likewise, additional fuel provided by second pump 34 is delivered to the cylinders by means of first pump 27. Only in the event the engine is operating at full load is there any fuel supplied to the engine by way of air intake passage 1, and in that event enriching tube 15, which projects into intake passage 1 supplies the excess fuel.

Choke 36 may be provided in intake passage 1 prior to venturi 1*a* and is operated in the customary manner, either manually or by means of a thermostatic control. When choke 36 is in a closed position, the pressure in the venturi section of passage 1 is lowered and a larger quantity of fuel is provided to pump 27 for cold starting of the engine.

As previously indicated, chamber 21 accumulates excess fuel upon the switching off of the ignition and the stopping of pump 27. Since this fuel is no longer provided to the engine by means of pump 27 or by the air intake, it is unnecessary to provide a cut-off device to prevent engine run-on.

In order to provide a better preparation of the rich fuel-air mixture from pump 27, there may be provided an electric resistance heating element 31 to raise the temperature of the mixture. In addition, a device 32 may be provided to mix exhaust gasses from the engine, supplied through passage 33, with the fuel-air mixture prior to injection into the intake manifold. The addition of exhaust gasses to the intake mixture is known to decrease emissions of noxious substances, particularly nitrous oxides. The supply of exhaust gasses to the fuel injection lines assures a uniform distribution of the gasses to the cylinders of the engine, and because of the high temperature level of the exhaust gasses, may result in a partial breaking down of the components in the fuel-air mixture into gaseous fuel components, which can be more efficiently utilized in the combustion chambers of the engine. This partial breakdown of fuel components is further promoted if a suitable catalyst is provided.

An alternative to the use of pump 34 and nozzle 24 for supplying excess fuel for rapid acceleration is illustrated in dotted lines in the drawing. Fuel line 36, pump 37 and fuel line 38, connected with main fuel line 5, may be used on rapid actuation of throttle 2 to provide excess fuel to the main fuel line and mixing passage 8. A small quantity of the excess fuel will return to flow chamber 3, but the greater quantity will be delivered to pump 27 through nozzles 17 or 19.

The fuel injecting device of the invention includes relatively simple fuel apportioning mechanisms, comparable to those used in a carburetor. Idling fuel is drawn through nozzle 19 by pump 27, and the amount of fuel drawn is determined by the intake pressure in the region of throttle 2. Normal operational fuel is drawn through nozzle 17 in a quantity which is dependent on the vacuum in the venturi. Closing of choke 36 increases this vacuum and consequently increases the fuel flow. Likewise, opening of throttle 2 to increase flow of air in the air intake increases the vacuum at the venturi and the flow of fuel in the main fuel line. When rapid acceleration is necessary, excess fuel is provided by pump 34 or 37. Only when the engine is operating at full load additional fuel is drawn through fuel enrichment tube 15, directly into the intake passage, in all other cases fuel is supplied by pump 27, mixed with air and injected into the intake manifold adjacent each cylinder port.

The apparatus combines the relatively inexpensive fuel apportioning techniques used in carburetors with the superior fuel distributing characteristics of high pressure liquid fuel injection. In addition, the device operates at relative low pressure levels, eliminating the need for critically machined parts generally required for fuel injection. Superior preparation of the fuel takes place by mixture with air and partial vaporization. This preparation is promoted if heating and/or exhaust gas blending is provided. The rich fuel-air mixture is sprayed into the intake manifold by atomizing jets to further promote blending with the intake air and promote complete and clean combustion.

While there have been described what are considered to be the preferred embodiments of the invention, those skilled in the art will recognize that other and further modifications may be made thereto without departing from the spirit of the invention and it is intended to claim all such embodments as fall within the scope of the invention.

I claim:

1. Apparatus for continuously injecting fuel into the intake passage of an internal combustion engine having at least one combustion chamber with an inlet connected to said intake passage, said apparatus comprising a first pump for delivering a rich fuel-air-mixture at a pressure higher than the pressure in said intake passage, means for connecting the outlet of said pump to an injection opening in said intake passage adjacent the inlet of each combustion chamber, and means for supplying fuel mixed with air to said first pump, said means including a device for regulating the quantity of said fuel supplied to said fuel pump in accordance with the negative pressure in a venturi portion of said air intake passage, said fuel regulating device including a float chamber, a main fuel line, a first fixed jet nozzle connecting said float chamber to said main fuel line and a suction opening in said venturi communicating with a section of said main fuel line and transmitting the negative pressure of said venturi to said section of said main fuel line, and further including a second fixed jet nozzle connecting said fuel regulating device with the intake of said first pump, wherein said air intake passage includes a throttle valve and wherein said fuel supply means includes an idling fuel line, connected to said float chamber by said first jet nozzle, bores connecting said idling fuel line to said intake passage adjacent said throttle valve, and a third jet nozzle connecting said idling fuel line with the intake of said pump.

2. Apparatus as specified in claim 1 wherein said main fuel line and said idling fuel line include vent nozzles for the addition of air to said fuel.

3. Apparatus as specified in claim 1 wherein there is provided a chamber for the accumulation of excess fuel when said first pump is switched off, said chamber being arranged in said idling fuel line between said bores and said third jet nozzle.

* * * * *

UNITED STATES PATENT AND TRADEMARK OFFICE

CERTIFICATE OF CORRECTION

PATENT NO. : 4,307,692

DATED : December 29, 1981

INVENTOR(S) : Ernst Fiala

It is certified that error appears in the above—identified patent and that said Letters Patent is hereby corrected as shown below:

Title page, Item [30], "2539920" should read --2639920--.

Signed and Sealed this

*First* Day of *June 1982*

[SEAL]

*Attest:*

GERALD J. MOSSINGHOFF

*Attesting Officer*

*Commissioner of Patents and Trademarks*